US008169398B2

(12) United States Patent
Iwasaki

(10) Patent No.: US 8,169,398 B2
(45) Date of Patent: May 1, 2012

(54) LIQUID CRYSTAL DISPLAY CONTROL CIRCUIT, OPERATION PANEL, AND IMAGE FORMING APPARATUS

(75) Inventor: Kazuya Iwasaki, Saitama (JP)

(73) Assignee: Ricoh Company, Limited, Tokyo (JP)

( * ) Notice: Subject to any disclaimer, the term of this patent is extended or adjusted under 35 U.S.C. 154(b) by 874 days.

(21) Appl. No.: 12/202,526

(22) Filed: Sep. 2, 2008

(65) Prior Publication Data

US 2009/0066633 A1 Mar. 12, 2009

(30) Foreign Application Priority Data

Sep. 11, 2007 (JP) ..... 2007-235471
Jun. 16, 2008 (JP) ..... 2008-157157

(51) Int. Cl.
*G09G 3/36* (2006.01)

(52) U.S. Cl. ..... 345/102; 345/204

(58) Field of Classification Search ..... 345/102, 345/98–100, 204
See application file for complete search history.

(56) References Cited

U.S. PATENT DOCUMENTS

| | | | | |
|---|---|---|---|---|
| 6,243,067 | B1 * | 6/2001 | Noguchi et al. | 345/102 |
| 6,504,523 | B1 * | 1/2003 | Sugawara et al. | 345/98 |
| 6,661,398 | B2 | 12/2003 | Iwasaki | |
| 6,741,239 | B2 | 5/2004 | Iwasaki | |
| 6,943,506 | B2 * | 9/2005 | Moon | 315/323 |
| 7,154,491 | B2 | 12/2006 | Iwasaki | |
| 2002/0005840 | A1 * | 1/2002 | Wicker | 345/204 |
| 2004/0104908 | A1 * | 6/2004 | Toyozawa et al. | 345/211 |
| 2006/0209059 | A1 | 9/2006 | Iwasaki | |

FOREIGN PATENT DOCUMENTS

| | | |
|---|---|---|
| JP | 8-248911 | 9/1996 |
| JP | 2002-333872 | 11/2002 |

* cited by examiner

*Primary Examiner* — Stephen Sherman
(74) *Attorney, Agent, or Firm* — Oblon, Spivak, McClelland, Maier & Neustadt, L.L.P.

(57) ABSTRACT

A first output unit outputs a control signal for removing a residual electric charge from a liquid crystal display module that includes a backlight. A reference-signal obtaining unit obtains a reference signal for setting a reference when turning on the backlight. A delay-time setting unit sets a delay time for delaying a turn-on time of the backlight from a turn-on time of the reference signal. A second output unit outputs a turn-on signal for turning on the backlight at a turn-on time delayed by the delay time from the turn-on time of the reference signal.

13 Claims, 10 Drawing Sheets

FIG. 4

| NO. | SIGNAL NAME |
|---|---|
| 1 | GND |
| 2 | +3.3 V |
| 3 | RESERVED (N.C.) |
| 4 | CLK |
| 5 | HSYNC |
| 6 | ENAB |
| ⋮ | ⋮ |
| 35 | DATA (G) 5 |
| 36 | GND |
| 37 | VSYNC |
| 38 | RESERVED (N.C.) |
| 39 | +3.3 V |
| 40 | GND |

FIG. 5

| NO. | SIGNAL NAME |
|---|---|
| 1 | GND |
| 2 | GND |
| 3 | DISP |
| 4 | CLK |
| 5 | HSYNC |
| 6 | VSYNC |
| ⋮ | ⋮ |
| 35 | DATA (B) 5 |
| 36 | RESERVED (N.C.) |
| 37 | ENAB |
| 38 | +3.3 V |
| 39 | +3.3 V |
| 40 | +3.3 V |

FIG. 6

| NO. | SIGNAL NAME |
|---|---|
| 1 | GND |
| 2 | +3.3 V |
| 3 | RESERVED (N.C.) |
| 4 | CLK |
| 5 | HSYNC |
| ⋮ | ⋮ |
| 35 | DATA (G) 6 |
| 36 | GND |
| 37 | VSYNC |
| 38 | RESERVED (N.C.) |
| 39 | +3.3 V |
| 40 | GND |
| 41 | SEL0 |
| 42 | SEL1 |

FIG. 7

| NO. | SIGNAL NAME |
|---|---|
| 1 | GND |
| 2 | +3.3 V |
| 3 | DISP |
| 4 | CLK |
| 5 | HSYNC |
| ⋮ | ⋮ |
| 35 | DATA (G) 6 |
| 36 | GND |
| 37 | VSYNC |
| 38 | RESERVED (N.C.) |
| 39 | +3.3 V |
| 40 | GND |
| 41 | SEL0 |
| 42 | SEL1 |

LIQUID CRYSTAL DISPLAY CONTROL CIRCUIT, OPERATION PANEL, AND IMAGE FORMING APPARATUS

CROSS-REFERENCE TO RELATED APPLICATIONS

The present application claims priority to and incorporates by reference the entire contents of Japanese priority document 2007-235471 filed in Japan on Sep. 11, 2007 and Japanese priority document 2008-157157 filed in Japan on Jun. 16, 2008.

1. FIELD OF THE INVENTION

The present invention relates to a liquid crystal display (LCD) control circuit, an operation panel, and an image forming apparatus.

2. DESCRIPTION OF THE RELATED ART

Conventionally, in an operation panel of an image forming apparatus etc., user convenience is improved by maintaining a standardized operability among various machines and a series of machines, and a long product life is demanded for a liquid crystal display (LCD) module that is used. Conventionally, because of a prevailing super twisted nematic (STN) LCD used in such devices, a custom LCD was developed and provided for a long term. However, for a currently prevailing thin film transistor (TFT) LCD module, because a development cost is high and providing a custom product is difficult, a general-purpose product is used.

Among manufacturers, for continuous cost cutting etc., the TFT LCD is developed at a high speed and models or production lines are changed in a comparatively short time. Thus, without conforming to the product life demanded by the image forming apparatus, it is necessary to adopt different models of a plurality of LCD manufacturers and also of the same manufacturer, around the same time or around different times. However, when the manufacturers are different or when the models of the same manufacturer differ, for cost cutting etc., an internal driver circuit needs to be modified, and interface (I/F) signals and request timing need to be changed.

Specifically, the I/F signals that change according to modification of the driver circuit are timing signals when boosting-up a driving voltage of the LCD from a logic voltage, and display control signals for clearing display data and removing a residual electric charge when disconnecting from a power supply. Those signals can be generated inside the driver circuit or can be received from an external device. When those signals are received from an external device, if the signals are not controlled in a normal timing, the LCD will be degraded with time.

Japanese Patent Application Laid-open No. H8-248911 discloses a technology for preventing deterioration of crystals in a LCD device by generating DISP signals by a switching transistor and a CR circuit using data latch pulses of LCD during a control signal being active.

However, the conventional technology as disclosed above cannot be applied to recently-developed LCD modules that take a long time, i.e., several frames for removing the residual electric charge. Moreover, in a personal computer, the signals can be timing-controlled under the control of a central processing unit (CPU) even during power cutoff. However, in the image forming apparatus, the CPU used for controlling is separated by speeding up and optimization of a process, and power of a display and a display controller is cut off to minimize power consumption during standby. However, due to this, display off controls at the time of warmup and power cutoff are not differentiated and it becomes difficult to exert a control by using software. To overcome the problem, conventionally the control was exerted by hardware modification etc. that meets LCD specifications. However, modifying the hardware in a comparatively short time results in a significant inefficiency and sometimes a new module cannot be loaded in an existing machine.

SUMMARY OF THE INVENTION

It is an object of the present invention to at least partially solve the problems in the conventional technology.

According to an aspect of the present invention, there is provided a liquid crystal display control circuit including a first output unit that outputs a control signal for removing a residual electric charge from a liquid crystal display module that includes a backlight; a reference-signal obtaining unit that obtains a reference signal for setting a reference when turning on the backlight; a delay-time setting unit that sets a delay time for delaying a turn-on time of the backlight from a turn-on time of the reference signal; and a second output unit that outputs a turn-on signal for turning on the backlight at a turn-on time delayed by the delay time from the turn-on time of the reference signal.

Furthermore, according to another aspect of the present invention, there is provided an operation panel including a liquid crystal display; and a liquid crystal display control circuit that controls the liquid crystal display. The liquid crystal display control circuit includes a first output unit that outputs a control signal for removing a residual electric charge from a liquid crystal display module that includes a backlight, a reference-signal obtaining unit that obtains a reference signal for setting a reference when turning on the backlight, a delay-time setting unit that sets a delay time for delaying a turn-on time of the backlight from a turn-on time of the reference signal, and a second output unit that outputs a turn-on signal for turning on the backlight at a turn-on time delayed by the delay time from the turn-on time of the reference signal.

Moreover, according to still another aspect of the present invention, there is provided an image forming apparatus including an operation panel that includes a liquid crystal display and a liquid crystal display control circuit that controls the liquid crystal display. The liquid crystal display control circuit includes a first output unit that outputs a control signal for removing a residual electric charge from a liquid crystal display module that includes a backlight, a reference-signal obtaining unit that obtains a reference signal for setting a reference when turning on the backlight, a delay-time setting unit that sets a delay time for delaying a turn-on time of the backlight from a turn-on time of the reference signal, and a second output unit that outputs a turn-on signal for turning on the backlight at a turn-on time delayed by the delay time from the turn-on time of the reference signal.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 4 is a table of an example of I/F signals of a conventional LCD module;

FIG. 5 is a table of another example of I/F signals of the conventional LCD module;

FIG. 6 is a table of an example of I/F signals of an LCD module in the operation panel according to the first embodiment;

FIG. 7 is a table of another example of I/F signals of the LCD module in the operation panel according to the first embodiment;

DETAILED DESCRIPTION OF THE PREFERRED EMBODIMENTS

Exemplary embodiments of the present invention are described in detail below with reference to the accompanying drawings.

Figure 1:
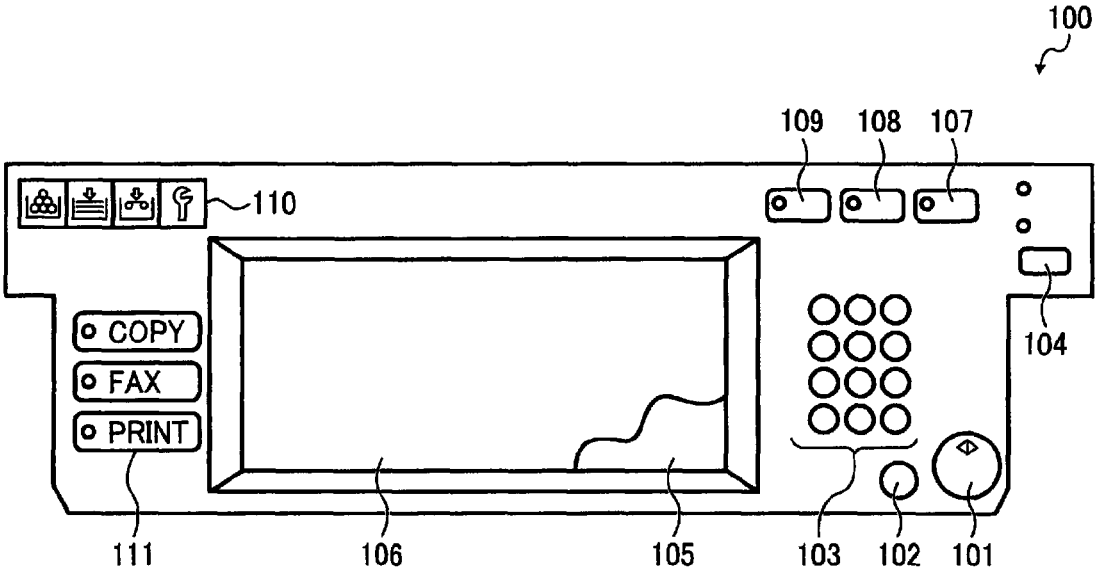
FIG. 1 is a schematic of an operation panel of an image forming apparatus according to a first embodiment of the present invention.

FIG. 1 is a schematic of an operation panel 100 of an image forming apparatus according to a first embodiment of the present invention. The image forming apparatus can be a digital multifunction peripheral (MFP), a facsimile, a scanner, a copying machine, a printer, or the like. The operation panel 100 includes an LCD module 105 and a touch panel 106. Complex functions can be easily set by touching soft keys on a screen. If the image forming apparatus is a digital MFP having a copy function, a facsimile function, and a print function, the operation panel 100 includes an application switchover key 111 for switching among copy, facsimile, and print functions. Further, the operation panel 100 includes various hard keys as common keys for each application, such as a start key 101 that starts copying and a facsimile (FAX) transmission, numeric keys 103 for specifying the number of copies and a transmission destination, a clear/stop key 102 that clears number or stops a copying operation etc., an interrupt key 107 for carrying out interrupt copy, a warmup key 108 for ON/OFF of a warmup mode, a program key 109 for maintaining and calling back a default copy mode etc., and additionally a power key 104 for on/off of a standby mode at which the power consumption is minimum. Moreover, the operation panel 100 includes an alert display 110 that illuminates various alert displays such as toner end by using a light emitting diode (LED).

Figure 2:
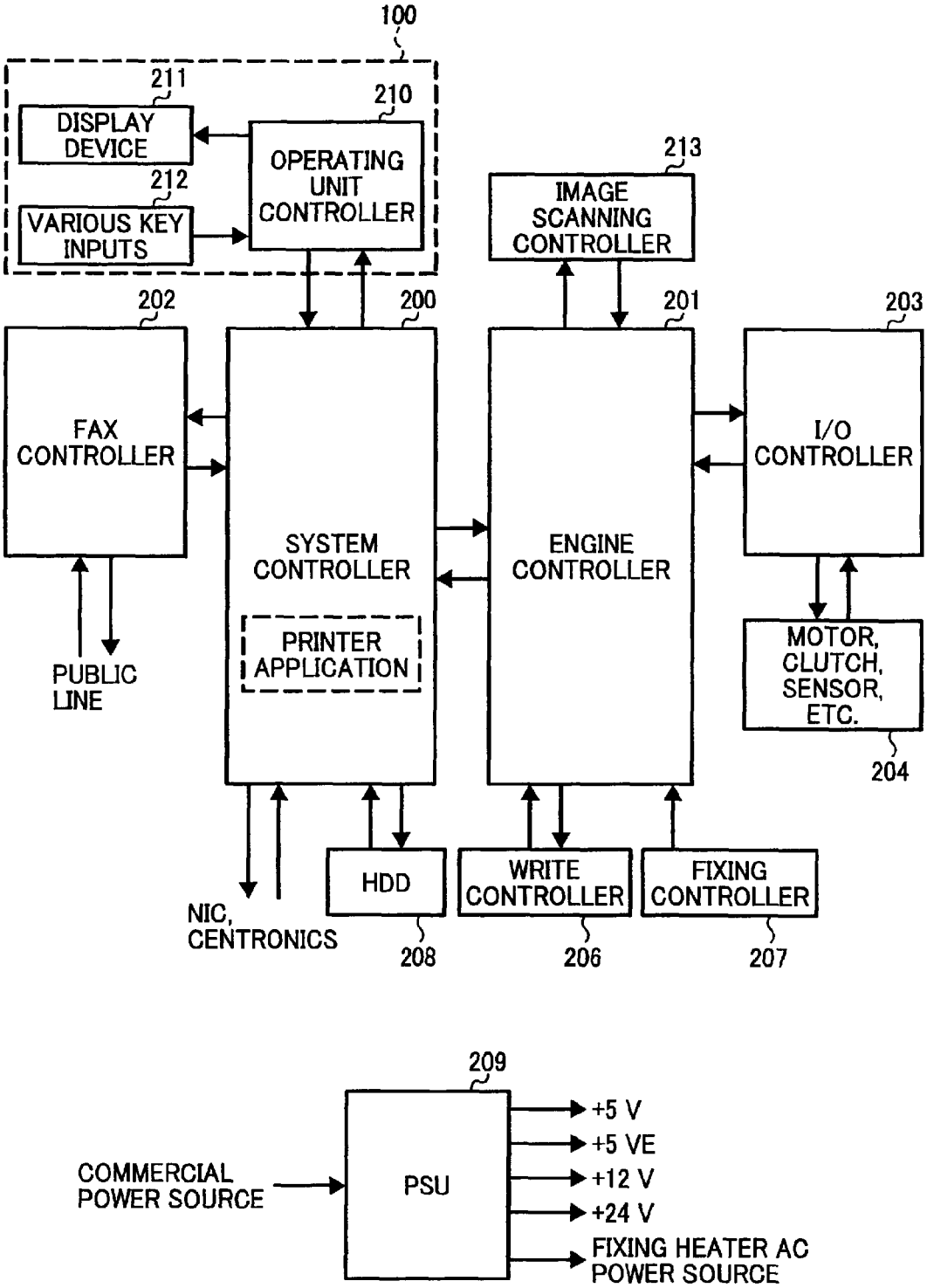
FIG. 2 is a block diagram of a control system of the image forming apparatus that includes the operation panel shown in FIG. 1.

FIG. 2 is a block diagram of a control system of the image forming apparatus that includes the operation panel shown in FIG. 1. The image forming apparatus includes a system controller 200 that performs various imaging processes, an engine controller 201 that controls operations of the image forming apparatus, and the operation panel 100 that displays operation mode settings and operating conditions. Further, a FAX controller 202 that controls FAX application and an external storage unit 208 such as a hard disk drive (HDD) that temporarily stores therein an image data are connected to the system controller 200. In the example of the system controller 200, a printer application can be extended by adding a programmable read only memory (ROM), and a printer output can be enabled by connecting to a server and a personal computer (PC) by using a network interface card (NIC) and n IEEE 1284 interface (I/F).

A fixing controller 207 that controls lighting of a fixing heater that heat-fixes a toner image on a sheet and controls temperature of a fixing roller, a write controller 206 that forms a static latent image on a photoreceptor in synchronization with sheet feeding, and an image scanning controller 213 that controls reading of originals are respectively connected to the engine controller 201. Further, the engine controller 201 is connected to an input-output (I/O) controller 203 that performs driving control of a motor 204 and a clutch 204 and performs input signal processing from various sensors 204.

The operation panel 100 includes an operating unit controller 210 (LCD control circuit) that controls display of display devices 211 such as the LCD module 105 and the LED inside the operation panel 100, and processes input data received from various key inputs 212 including the touch panel 106 and the hard keys 101 to 104, 107 to 109, and 111.

The image forming apparatus includes a power supply unit (PSU) 209 that supplies power to those units. The PSU 209 works as a direct current (DC) power supply that rectifies, flattens, or steps down a commercial power, or a heater power supply that turns on the fixing heater.

Figure 3:
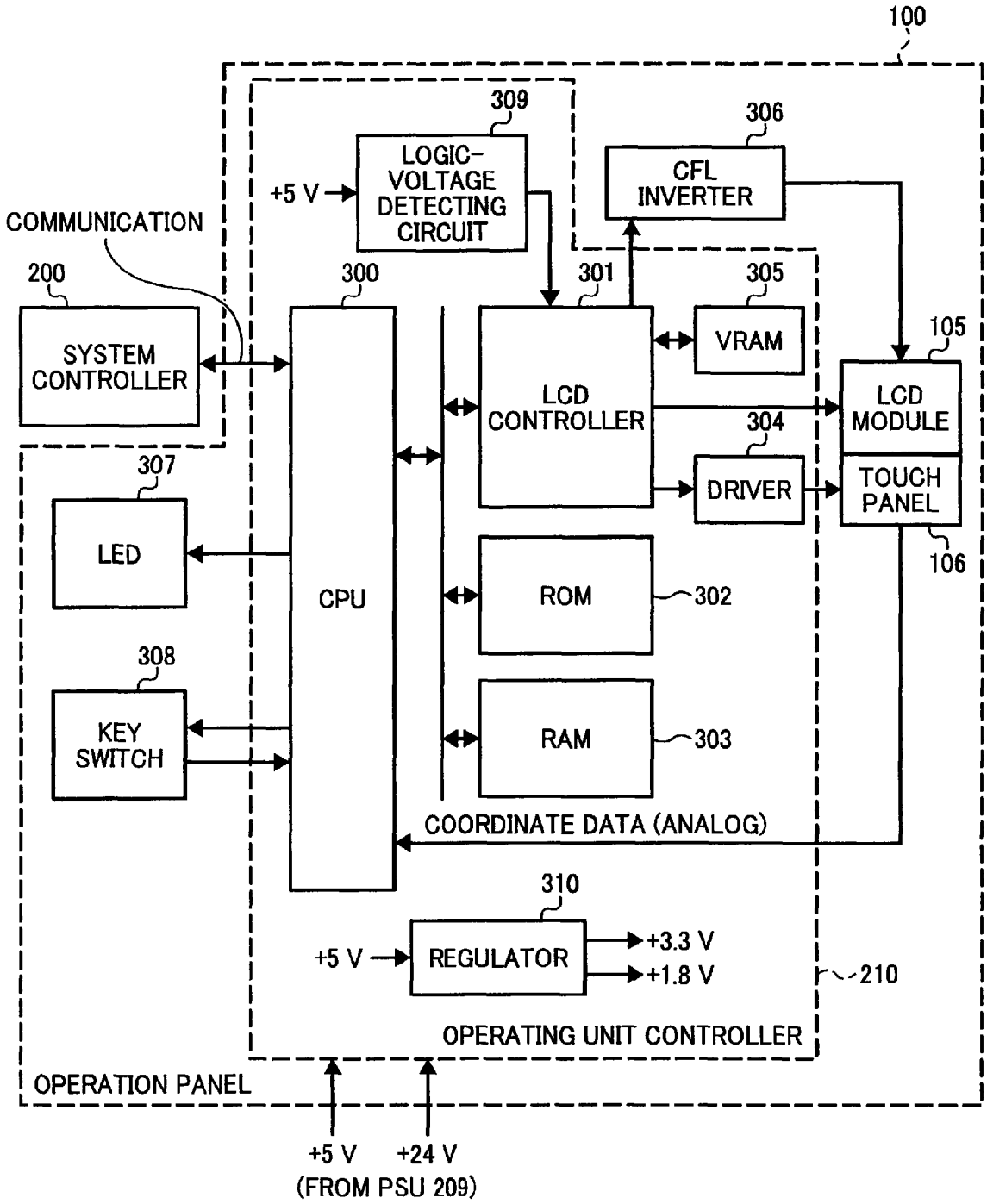
FIG. 3 is a block diagram of the operation panel shown in FIG. 1.

FIG. 3 is a block diagram of an example of the operation panel 100 shown in FIG. 1. The operation panel 100 includes a central processing unit (CPU) 300 that includes a single chip microcomputer. The CPU 300 is connected to the system controller 200 by an internal communication function. A ROM 302 that stores therein control programs and data, a random access memory (RAM) 303 that temporarily stores therein and processes a process data, and an LCD controller 301 that controls display of the LCD module 105 and driving of the touch panel 106 are connected to each other via a CPU bus. A video RAM (VRAM) 305 that stores therein a display data of the LCD module 105 is connected to the LCD controller 301. The display data is successively read from the VRAM 305 and sent to the LCD module 105 along with a clock and synchronizing signals. Further, signals that control lighting of a backlight of the LCD module 105 are output by a cathode fluorescent lamp (CFL) inverter 306 and a high voltage output from the CFL inverter 306 is supplied to a CFL lamp that serves as the backlight inside the LCD module 105. The touch panel 106 often uses analog system. Further, a bias control of the touch panel 106 is performed via a driver 304 based on a port data of the LCD controller 301 and a depressing coordinate data is detected at an analog port of the CPU 300.

An LED 307 and a key switch 308 are connected to a general-purpose port of the CPU 300. The CPU 300 controls lighting of the LED 307 and processes the input data from the key switch 308. A logic-voltage detecting circuit 309 monitors a voltage of a logic circuit, and generates reset signals for initialization and sends the generated reset signal to the CPU 300 and the LCD controller 301. The PSU 209 supplies power of +24 volts and +5 volts. When a voltage accuracy less than or equal to 3 volts is required internally, power of a required voltage is generated inside a control board by a regulator 310.

Based on the structures shown in FIGS. 1 to 3, a detailed structure and operations of the operation panel 100 are explained below. Concrete examples of I/F signals of the LCD module 105 are explained with reference to FIGS. 4 to 7. FIGS. 4 and 5 are tables of an example of the I/F signals of a conventional LCD module. FIGS. 6 and 7 are tables of an example of the I/F signals of the LCD module according to the first embodiment.

When model numbers and manufacturers are different for the LCD modules 105, as shown in FIGS. 4 and 5, a sequence of the I/F signals and a required signal number often differ. In the example, the I/F signals shown in FIG. 4 do not include DISP signals, whereas the I/F signals shown in FIG. 7 include the DISP signals. The DISP signals are timing signals for removing a residual electric charge in a thin film transistor (TFT) inside the LCD module 105. On the other hand, because the LCD module shown in FIG. 5, in which the I/F signals are input, includes the timing signals or a unique residual-electric-charge removing circuit that perform a process of removing the residual electric charge in the TFT inside an LCD driver of the LCD module, the DISP signals need not be externally supplied. Further, a red, green, blue (RGB) display data and a power source, and GND signals (not shown) are included in the tables.

In the operating unit controller 210, a similar control is possible for the LCD module that requires the DISP signals and the LCD module that does not require the DISP signals. However, as shown in FIGS. 4 and 5, when the I/F signals assigned to a connector that connects the LCD modules widely differ, a separate control board needs to be provided. Therefore, in the first embodiment, as shown in FIGS. 6 and 7, the sequence of the I/F signals and the signal number assigned to the connector that connects the LCD modules 105 is the same between the LCD modules 105. The LCD module 105 that does not require the signals is assumed as reserved and not connected (N.C.). Due to this, when assigning the signals to the connector that is connected to the LCD modules 105, for example, when the LCD module 105 that does not require the DISP signals is connected, a terminal of the connector to which the DISP signals are assigned is assumed as a reserve terminal. Other signals are assigned to a terminal identical to the LCD module 105 that requires the DISP signals and thus a plurality of the LCD modules 105 can be dealt with by using the same I/F. By prior arranging for a large number of the reserved (N.C.) LCD modules 105, even when the LCD module 105 that further requires other signals is used, the control board of a new circuit can be used also at the time of maintenance of an old machine.

Figure 8:
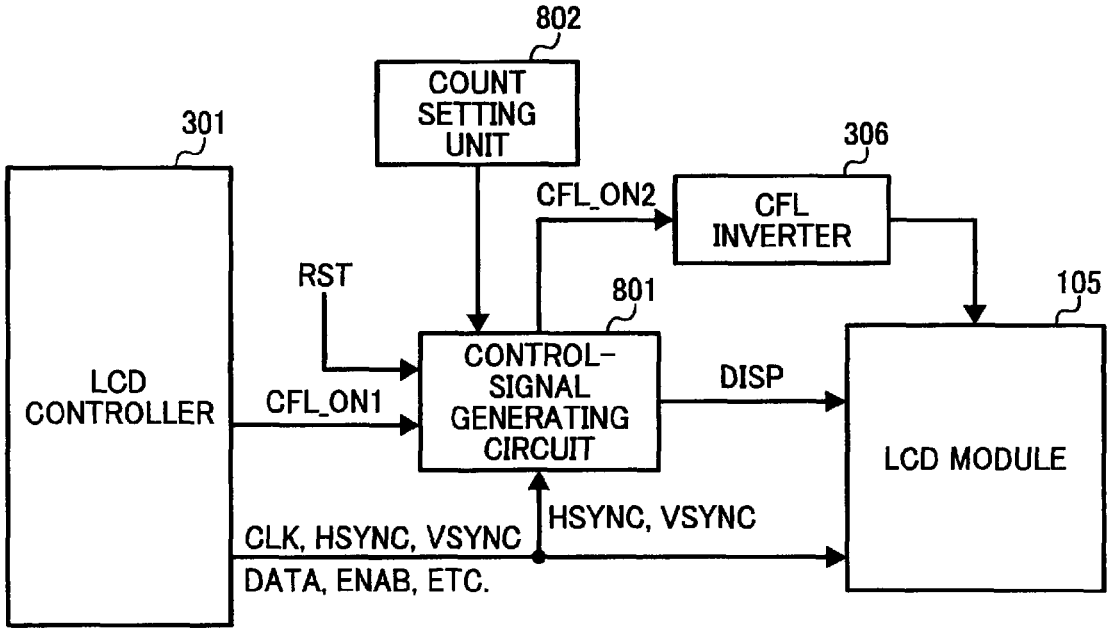
FIG. 8 is a block diagram of main parts of an operating unit controller, a CFL inverter, and the LCD module according to the first embodiment.

FIG. 8 is a block diagram of main parts of the operating unit controller 210, CFL inverter 306, and the LCD module 105. As shown in FIG. 8, in the operating unit controller 210, a control-signal generating circuit 801 is set between the LCD controller 301 and the LCD module 105. The control-signal generating circuit 801 generates the DISP signals from reference signals (CFL_ON1) that serve as a reference when lighting the backlight of the LCD module 105, vertical synchronizing signals (VSYNC), and horizontal synchronizing signals (HSYNC). The CFL_ON1, the VSYNC, and the HSYNC are commonly required signals in various LCD modules. The control-signal generating circuit 801 then outputs the DISP signals. Moreover, in the present embodiment, the control-signal generating circuit 801 retrieves CFL_ON1, CLK, HSYNC, VSYNC, DATA, ENAB etc. from the LCD controller 301. DATA is a display data displayed on the LCD module 105. ENAB is the signals that enable the operating unit controller 210. CLK is periodic signals indicative of the timing of operating the operating unit controller 210.

Because a normal display timing of the LCD module 105 changes according to the generated DISP signals, to light the backlight at an appropriate timing, the control-signal generating circuit 801 generates and outputs turn-on signals (CFL_ON2) for turning on the backlight at a turn-on time delayed by a delay time, which is set by a count setting unit 802 that is described later, after CFL_ON1 are turned on.

The count setting unit 802 sets the delay time for each LCD module to ensure a time for removing the residual electric charge in response to the DISP signals. The turn-on time of turning on the backlight is delayed by the delay time after CFL_ON1 is turned on. The count setting unit 802 sets number of the VSYNCs countable within the period for removing the residual electric charge in response to the DISP signals (hereinafter, "count value") as the delay time, and sets the specified delay time in the control-signal generating circuit 801. Depending on on/off of the CFL_ON2 that is generated, the CFL inverter 306 supplies the high voltage output to the CFL lamp inside the LCD module 105 and lights the CFL lamp.

Figure 9:
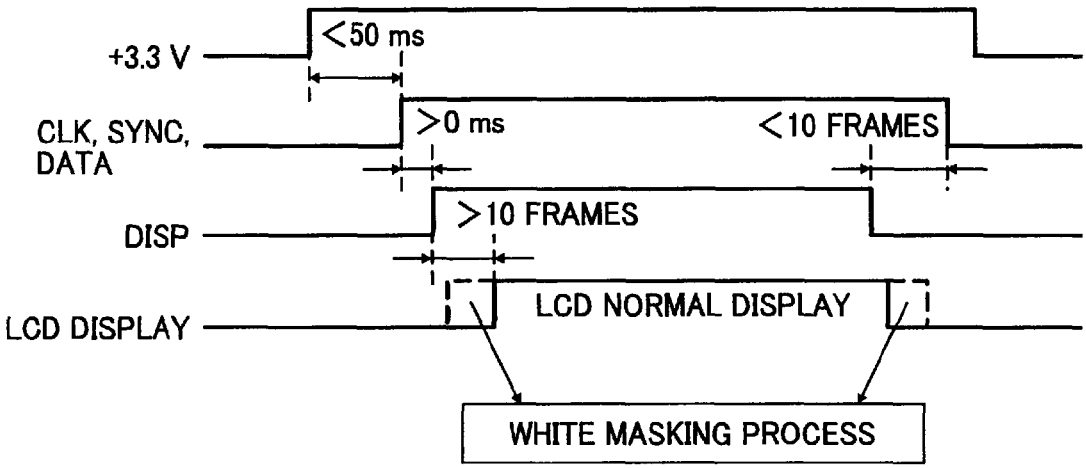
FIG. 9 is a time chart of DISP signals and relevant signals according to the first embodiment.

FIG. 9 is a time chart of the DISP signals and relevant signals. As shown in FIG. 9, the operating unit controller 210 performs, upon the DISP signals turning from off ("L") to on ("H") or from on ("H") to off ("L"), a white masking process of turning off the backlight inside the LCD module 105 and removes the residual electric charge inside the LCD module 105. Upon turning the DISP signals from off ("L") to on ("H"), if the backlight is turned on before the normal display timing, the display becomes abnormal. On the other hand, upon turning the DISP signals from on ("H") to off ("L"), if power of the LCD module 105 is cut off without waiting for a required frame time, the LCD module 105 deteriorates with time due to a direct bias application. At that time, the operating unit controller 210 executes the white masking process upon the DISP signals turning from off ("L") to on ("H") or from on ("H") to off ("L"). Thus, the DISP signals are important signals. Conventionally, in a system that selects and uses both the devices in which the I/F signals required by the operating unit controller 210 of the LCD module 105 are different, it was necessary to combine the control circuit and the LCD, and the system became inefficient. Therefore, in the present embodiment, the common operating unit controller 210 can be used for the LCD module that does not require the DISP signals and for the LCD module that requires the DISP signals.

Figure 10:
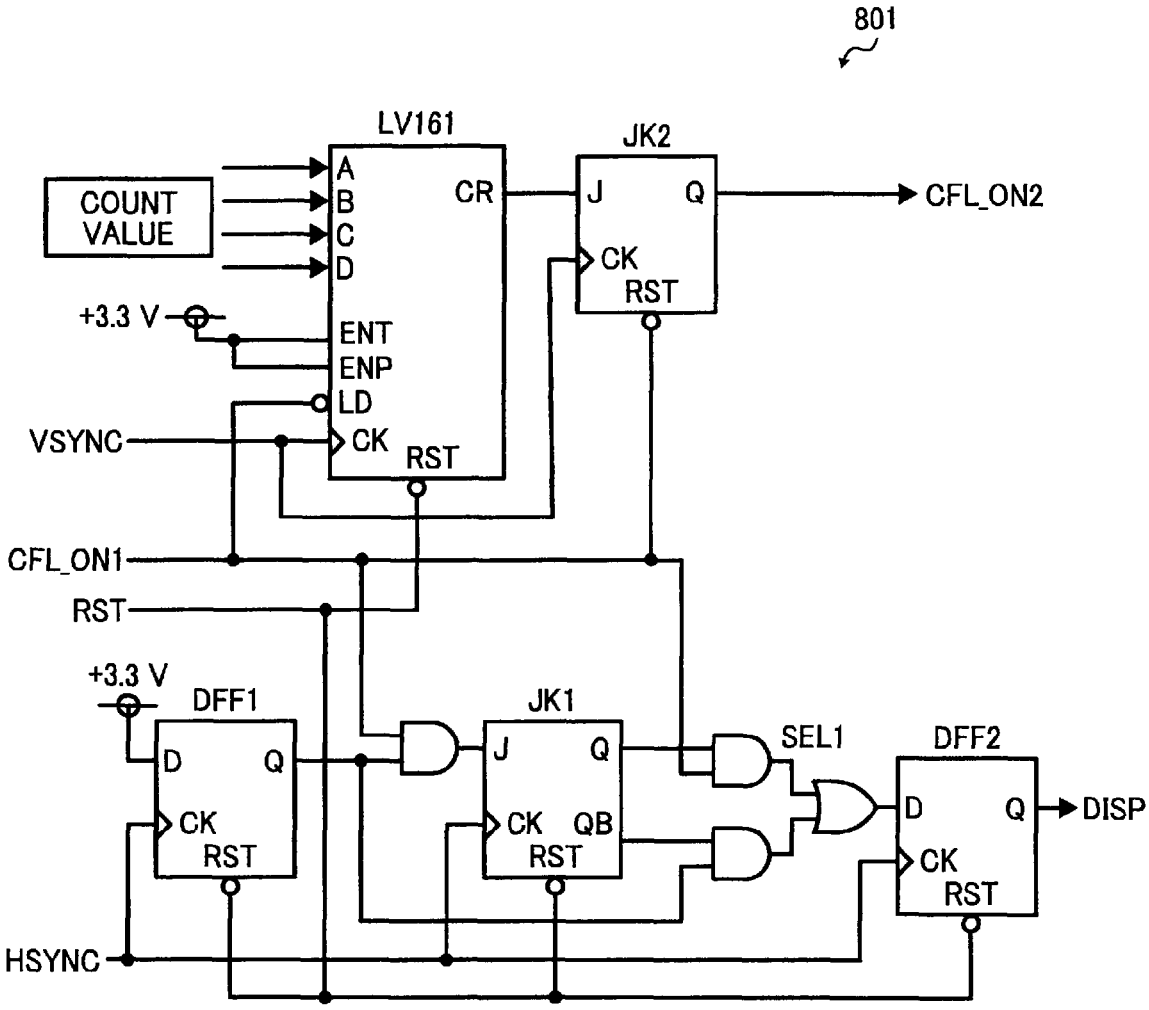
FIG. 10 is a detailed block diagram of a control-signal generating circuit according to the first embodiment.
Figure 11:
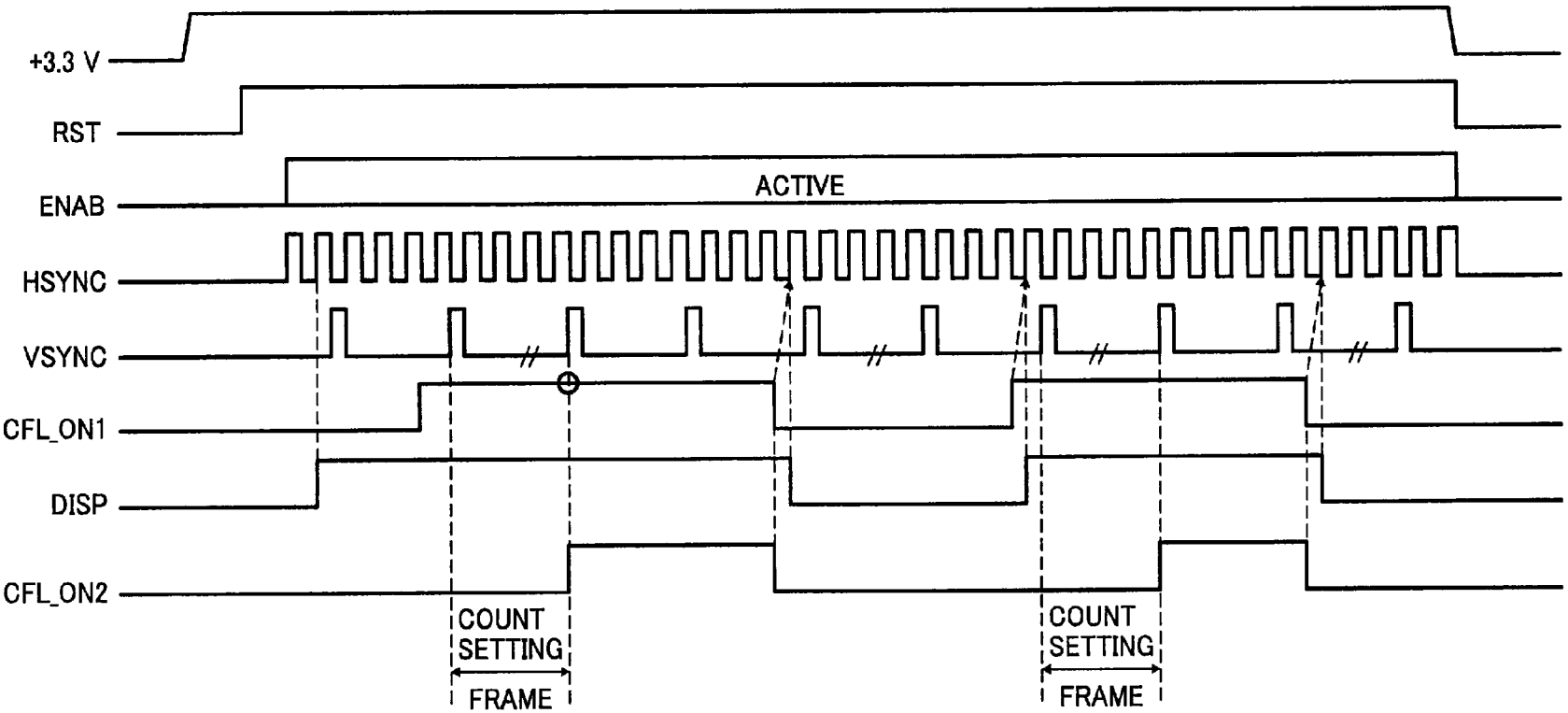
FIG. 11 is a time chart of signals output from the control-signal generating circuit according to the first embodiment.

A detailed structural example and operations of the control-signal generating circuit 801 are explained with reference to FIGS. 10 and 11. FIG. 10 is a detailed block diagram of the control-signal generating circuit 801. FIG. 11 is a time chart of the signals output from the control-signal generating circuit 801.

An operation when the image forming apparatus is switched on is explained first. When the image forming apparatus is switched on and reset (RST) is cancelled, a first HSYNC rises and DFF1 latches H level. Because a status of JK1 is the same as a reset status, outputs of the DFF1 are directly conveyed to DFF2. Thus, a second HSYNC rises and the DISP signals are turned on ("H"). When the CFL_ON1 becomes "H" (the backlight is turned on), output of an AND circuit immediately before the JK1 becomes "H" and the output of the JK1 is inverted at the next HSYNC. However, because the CFL_ON1 has become "H", the status of the DISP signals does not change. Further, when the CFL_ON1 becomes "H", a load status of a counter in LV161 and the reset status of a second JK flip-flop (JK2) are cancelled, and the LV161 counts VSYNC from a value obtained by subtracting from FFH the count value set by the count setting unit 802 to FFH. If a count value of the LV161 becomes FFH, "carry" is output to the JK2, then CFL_ON2 becomes on ("H") at the next VSYNC, and the backlight is turned on.

In this manner, taking the situation into consideration in which, after image forming apparatus is switched on, the period between turning of the DISP signals on ("H") and turning of CFL_ON1 on ("H") is smaller than the specified number of frames (i.e., ten frames) indicated in FIG. 9, the countable number of value is set by the count setting unit 802 and the timing of turning on ("H") CFL_ON2 is delayed by the frame number, which satisfies the specifications of the LCD module 105.

To transit to the warmup mode and an energy saving mode, an operation of turning the backlight off is explained below. When CFL_ON1 becomes off ("H" to "L"), the JK2 changes to reset. Therefore, CFL_ON2 becomes "L" in synchronization with CFL_ON1 and instantaneously the backlight is turned off. Moreover, because the output of SELL also becomes "L", the DISP signal also becomes "L" at the next HSYNC. Thus, the white masking process starts inside the LCD module 105. Consequently, although power of the operation panel 100 is disconnected by directly transiting to the energy saving mode, a white masking period secures a time period that satisfies requirement specifications and thus deterioration of the LCD module 105 can be prevented. On the other hand, in the warmup mode, subsequently the backlight is again turned on ("H"). At that time, if CFL_ON1 again becomes "H", the DISP signal becomes "H" at the next HSYNC, and a display operation starts. Until just before, because LV161 is in the load status and the JK2 is in the reset status, CFL_ON2 is delayed by a specified frame number same as at the time of switching on and thus abnormal display is avoided.

A count value setting method for setting the count value to the control-signal generating circuit 801 according to the first embodiment is explained below. Generally, the count value that uses a program counter such as LV161 is expressed by adding one to an inverse number of a binary number of the required count. For example, when a carry signal is latched after ten counts and output, 1H can be added to 0101H, which is the inverse number of 1010H, and 0110H can be set. The count setting unit 802 also sets, conforming to the requirement specifications of the LCD module 105, the count value in a similar manner, when generating CFL_ON2 from CFL_ON1.

Figure 12:
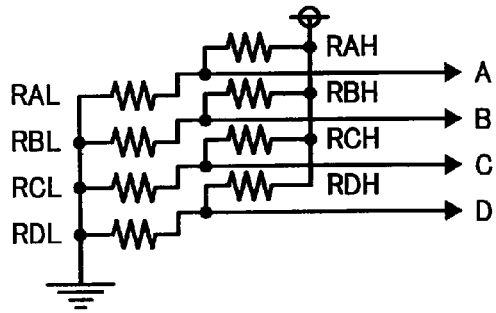
FIG. 12 is a diagram of pull-up resistors and pull-down resistors by operations of which count value is set.

In the first embodiment, the count value is set by the count setting unit 802 by using various setting methods conforming to production methods and maintenance methods. Accordingly, among a plurality of count value setting methods, a method that is best suitable for a type of a system and the LCD module can be selected, and a most effective control system can be configured. FIG. 12 is a diagram of pull-up resistors and pull-down resistors by operations of which the count value is set. The operating unit controller 210 is connectable to the pull-up resistor and the pull-down resistor. The count setting unit 802 sets the count value (delay time) depending on a connection status of the pull-up resistor and the pull-down resistor of the operating unit controller 210. For example, as described earlier, when 0110H is set, the count value can be set without RAH, RDH and RBL, RCL. In LV161, A is at a lowest position and D is at a highest position. In the above setting method, among a plurality of the LCD modules 105 that are used, when more than one LCD module 105 that do not require the DISP signals are used and one LCD module 105 that requires the DISP signals is used, the cost can be reduced.

Figure 13:
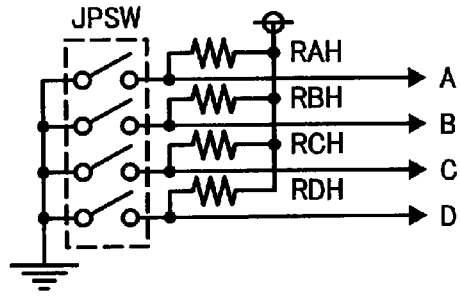
FIG. 13 is a diagram of jumper switches by operations of which the count value is set.

FIG. 13 is a diagram of jumper switches by operations of which the count value is set. The jumper switches such as DIP switches, are connected to the operating unit controller 210. The count setting unit 802 sets the count value (delay time) by switching on/off of the jumper switch. When the count value is to be set to "0", the jumper switch is switched on and when the count value is to be set to "1", the jumper switch is switched off. The setting method is effective when, among a plurality of the LCD modules 105 that are used, more than one LCD modules 105 that require the DISP signals are used. In the system, because the count value can be changed on a production line according to the LCD module 105, any LCD module 105 can be switched on. Moreover, the LCD modules 105 need not be limited even at the time of LCD replacement.

Furthermore, in another setting method, the count values are output from a port of the CPU 300 and a blank port of the LCD controller 301. In the setting method, as shown in FIG. 13, among a plurality of the LCD modules 105 that are used, when more than one LCD modules 105 that do not require the DISP signals are used and one LCD module 105 that requires the DISP signals is used, the cost is minimum only when an opening required for the port is provided.

Figure 14:
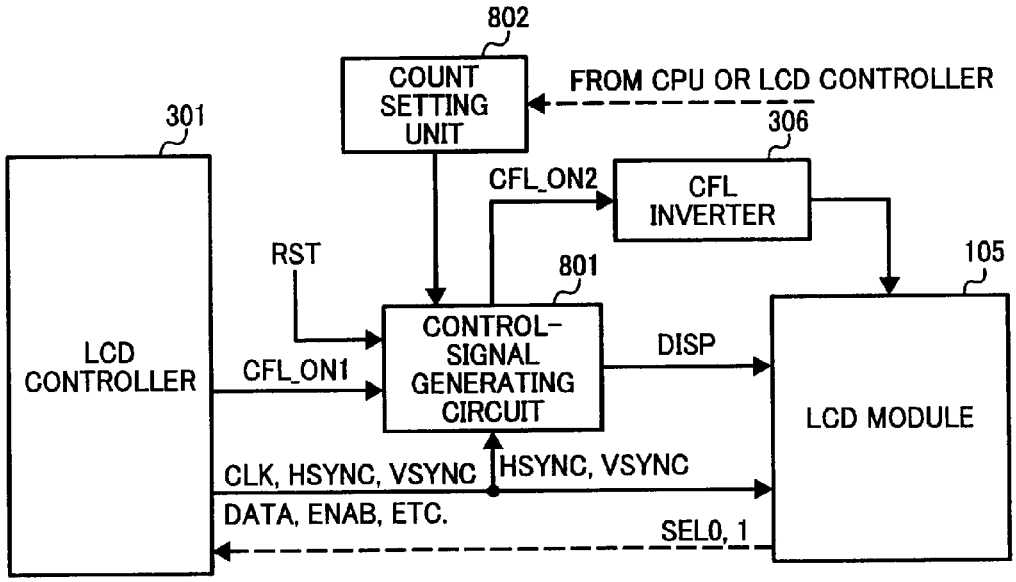
FIG. 14 is a block diagram for explaining a method of setting the count values from a signal received from a CPU or an LCD controller.
Figure 15:
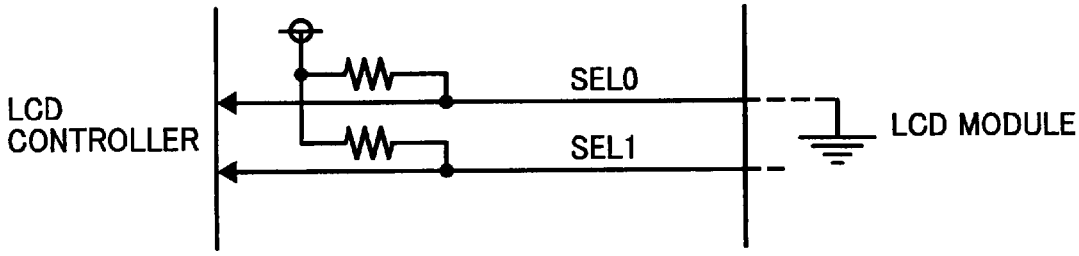
FIG. 15 is a diagram for explaining a pull-down process depending on each LCD module.

FIG. 14 is a block diagram for explaining a method of setting the count values from a signal received from the CPU or the LCD controller. When the count values are output from the port of the CPU 300 and the blank port of the LCD controller 301 and set, as shown in FIG. 14, by setting identification signals (SEL0, 1) for identifying the type of the LCD module 105, self-identification can be performed by using software. FIG. 15 is a diagram for explaining a pull-down process depending on each LCD module. The identification signals (SEL0, 1) are normally pulled up as shown in FIG. 15. The pull-down process is changed according to the module on a side of the LCD module 105, then values of SEL0, 1 are detected and read by the CPU 300 via the LCD controller 301, and thus the LCD modules 105 can be identified. As shown in FIG. 14, SEL0, 1 are connected to the general-purpose port of the LCD controller 301, and the CPU 300 reads a value of the port and performs differentiation.

The CPU 300 assigns, from the general-purpose port of the CPU 300 and the LCD controller 301, to the count setting unit 802 the count values suitable for the LCD module 105 that is identified based on the detected values of SEL0, 1, and exerts a timing control suitable for the LCD module 105. Further, the count setting unit 802 sets the count values (delay time) assigned from the CPU 300 and the LCD controller 301. Due to this, a control of the LCD module 105 can be changed to an optimum control by using software control. In the above example, the identification signals are two bits, four values of SEL 0, 1. However, when the LCD module 105 is bigger, number of bits can be increased. Further, a default signal process can be assumed as the pull-down process.

Further, the count value, which is input via the key switch 308 included by the operation panel 100, can also be set. The CPU 300 assigns to the count setting unit 802 the count value (delay time) input via the key switch 308 and the count setting unit 802 sets the count value. For example, the method described earlier is an effective setting method when an operator directly inputs the count value to the image forming apparatus. At that time, the operator needs to prior search for the count value suitable for the LCD module 105. Alternatively, a suitable count value can be selected and set while changing the count value set by the count setting unit 802.

In an image forming apparatus according to a second embodiment of the present invention, by selecting the signals that control lighting of the backlight depending on the LCD module that is mounted, the backlight can be lit in a normal time period for the LCD module that does not require the DISP signals. Thus, a delay in the display timing of the LCD module 105 can be prevented. Because the structure of the image forming apparatus according to the second embodiment is the same as the structure of the image forming apparatus according to the first embodiment except that processes performed by components that are different from the first embodiment are explained further.

Figure 16:
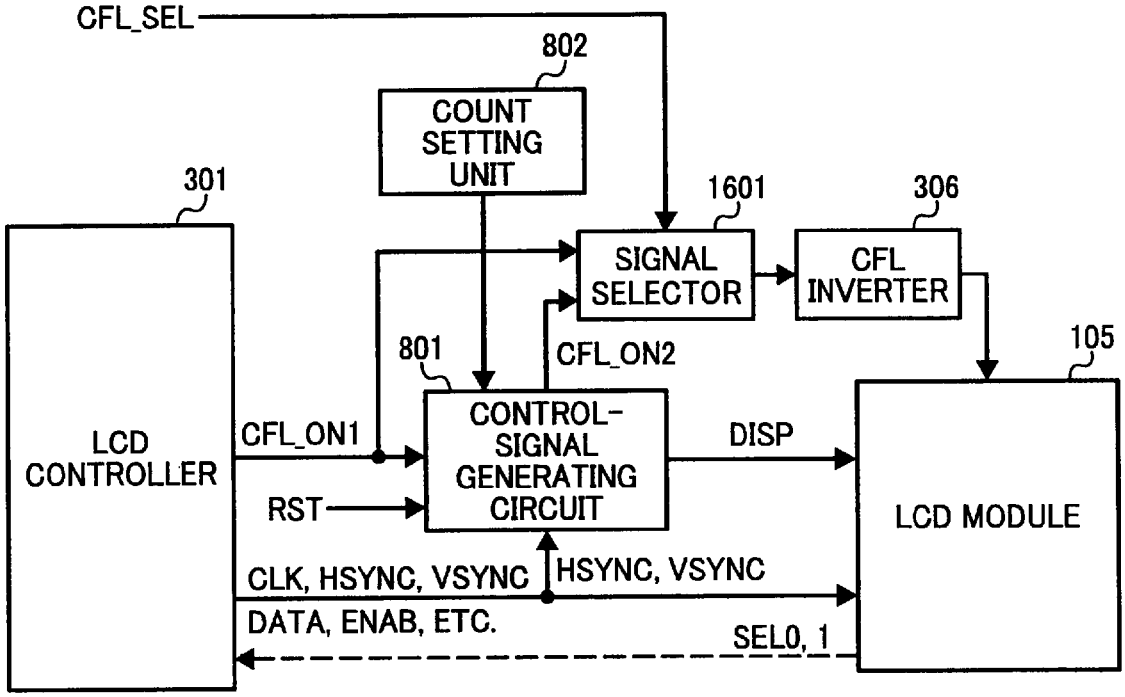
FIG. 16 is a block diagram of main parts of an operating unit controller, a CFL inverter, and an LCD module according to a second embodiment of the present invention.

FIG. 16 is a block diagram of the main parts of an operating unit controller, the CFL inverter 306, and the LCD module 105 according to the second embodiment. As described earlier, the LCD module that does not require the DISP signals can be used as the LCD module 105. The operating unit controller according to the second embodiment includes a signal selector 1601 shown in FIG. 16. When the identification signals of the LCD module 105 indicate the LCD module that does not require the DISP signals, the signal selector 1601 switches the signal to be sent to the CFL inverter 306 from CFL_ON2 to CFL_ON1. Thus, the backlight is turned on at an original timing.

Upon reading the value of the identification signals (SEL0, 1) and determining that the LCD module 105 is the LCD module 105 that does not require the DISP signals, the CPU 300 inputs to the signal selector 1601, CFL_SEL signals that indicate selection of CFL_ON1 that are output from the general-purpose port of the LCD controller 301 (CPU 300) and switches in a direction of selecting CFL_ON1. Due to this, the signals input towards the CFL inverter 306 become CFL_ON1 and the backlight can be turned on/off in the original timing. When the LCD module 105 does not require the DISP signals, because a backlight control need not be delayed, a responsivity can be enhanced by controlling the backlight in the original timing.

In an image forming apparatus according to a third embodiment of the present invention, by setting a frame rate of the LCD module during the backlight being on different from a frame rate of the LCD module during the backlight being off, the delay time due to the timing control for lighting the backlight can be minimized while dealing with various LCD modules. Because the structure of the image forming apparatus according to the third embodiment is the same as the structure of the image forming apparatus according to the first embodiment except that the processes performed by the components that are different from the first embodiment are explained further.

Figure 17:
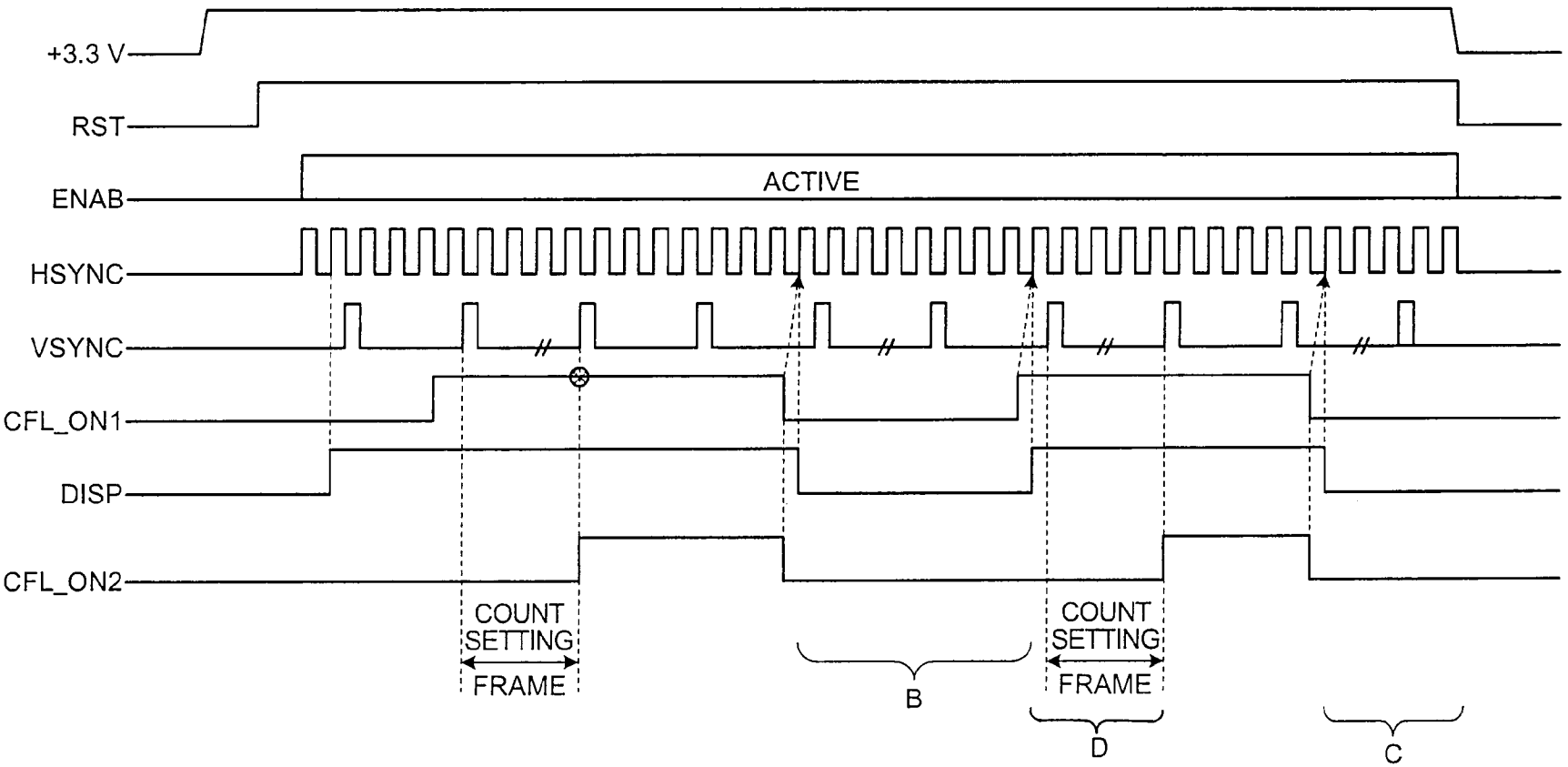
FIG. 17 is a time chart illustrating a period having a different frame rate according to a third embodiment of the present invention.

The typical allowable frame rate of the LCD module 105 is from 40 hertz to 80 hertz. If the frame rate is high, a higher data processing speed is required. Therefore, although a frame rate is usually set to about 60 hertz, the frame rate often varies due to controlling blinking caused by interference with light fixtures. As shown in FIG. 5, because a processing time for removal of the residual electric charge inside the LCD module 105 is specified by the frame number, if the frame rate is increased, the processing time can be reduced. Although unexpectedly power is manually cut off during the processing time, an effect of crystal deterioration can be reduced. Due to this, in the third embodiment, the LCD controller 301 sets the frame rate during the DISP signals being off ("L") higher than the frame rate during the DISP signals being on ("H"). FIG. 17 is a time chart illustrating a period having a different frame rate. The LCD controller 301 sets the frame rate during the period indicated by B show in FIG. 17 higher than the frame rate during the DISP signals rise.

When the DISP signals are off ("L"), the backlight is also turned off. Therefore, the frame rate can be increased without any apparent problems. To increase the frame rate, the LCD controller 301 can speed up a clock used for data processing. Recently, because a clock generator can be regulated by a phase-locked loop (PLL) system, the LCD controller 301 can easily speed up the clock if divisions of a divider inside a PLL circuit are fine-tuned.

As described earlier, if the frame rate is increased, a higher processing speed is required. Therefore, the frame rate cannot be increased at random. Normally, because the control circuit is configured such that a range of an optimum frame rate of the LCD can be controlled, the LCD controller 301 practically sets the frame rate during the DISP signals being off ("L") as a maximum value according to the specifications of the LCD module 105.

On the other hand, when the DISP signals change from off ("L") to on ("H"), consequently, the LCD controller 301 according to the present embodiment delays lighting of the backlight. Reducing the delay time is also enhances a user I/F. Therefore, the LCD controller 301 according to the present embodiment sets the frame rate during CFL_ON2 being off higher than the frame rate during CFL_ON2 being on. Due to this, although the DISP signals change from off ("L") to on ("H"), the frame rate can be increased during the backlight being turned off and the delay time can be reduced. The time period mentioned above is the time period indicated by B and C shown in FIG. 17. To return the frame rate in the normal timing, after switching on ("H") CFL_ON1, a setting value of PLL can be returned in a timing at which an output number of VSYNC of the LCD controller 301 equals the count value set by the count setting unit 802. Returning the frame in the normal timing can be achieved by an interrupt count process of VSYNC inside the LCD controller 301.

When a backlight response time is short, blinking etc. can occur in the display of the LCD module 105, in a small time period till the frame rate is returned after returning to a normal value of the setting value of PLL. At that time, the LCD controller 301 according to the present embodiment can exert a control such that the frame rate is reduced (the frame rate slows down in stages) since the time period when the DISP signals are turned on ("H") till the time period when CFL_ON2 are turned off. If the CFL_ON is turned on ("H") by using the software, the DISP signals turn on ("H") in synchronization with the next VSYNC. Therefore, the CPU 300 can prior change the setting value of PLL such that a clock speed slows down for every interruption of VSYNC that occurs after CFL_ON1 is turned on ("H") and can adjust such that the setting value of PLL becomes the normal value till a point at which the count value of the count setting unit 802 is reached.

According to an embodiment of the present invention, the backlight lighting timing can be changed depending on the time required for removal of the residual electric charge in the LCD module 105 that is a control target. Therefore, although the LCD module 105, which is the control target, is changed, the abnormal display, which occurs when the backlight is lit without waiting for the time required for removal of the residual electric charge in the LCD module 105, can be prevented and a new LCD module can be loaded in the old machine without changing the control circuit.

When assigning the signals to an I/F connector that is connected to the LCD module 105, if the LCD module 105 that does not require the DISP signals that process the residual electric charge is connected, the terminal of the connector to which the DISP signals are assigned is assumed as the reserve terminal and other signals are assigned to the terminal identical to the LCD module 105 that requires the DISP signals, and thus various LCD modules 105 can be dealt with by using the same I/F.

A method best suitable for the type of the system and the LCD module 105 can be selected among a plurality of the count value setting methods and the most effective control system can be configured. Further, the CPU 300 detects the identification signals for identifying the type of the LCD module. By setting the count value conforming to the LCD module 105 identified from the detected identification signals, the control of the LCD module 105 can be changed to the optimum control by using the software control.

Moreover, by setting the signal selector 1601 that selects CFL_ON1 or CFL_ON2 that control lighting of the backlight, for the LCD module 105 that does not require the DISP signals, the timing can be assumed as a normal backlight-lighting control timing, and thus the delay in the display timing can be prevented.

Further, by increasing the frame rate during the DISP signals being off ("L") and the frame rate during the backlight being off, the delay time, which occurs due to controlling the backlight lighting timing while dealing with various LCD modules 105, can be minimized. A change from the high frame rate during the DISP signals being off ("L") to the normal frame rate when CFL_ON2 are on ("H") is slowed down in stages since the DISP signals are turned on ("H") till the backlight is turned on as shown in period D in FIG. 17. Thus, blinking etc. during the display can be prevented while minimizing the delay time.

According to an aspect of the present invention, a backlight lighting timing can be changed depending on a time required for removal of a residual electric charge in an LCD module to be controlled. Therefore, even if the LCD module to be controlled is switched from a first LCD module to a second LCD module, an abnormal display, which occurs when the backlight is lit without waiting for the time required for removal of the residual electric charge in the LCD module, can be prevented. Thus, a new LCD module can be installed in an old machine without changing a control circuit.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid crystal display control circuit, comprising:

a first output unit configured to output a control signal for removing a residual electric charge from a liquid crystal display module that includes a backlight;

a reference-signal obtaining unit configured to obtain a reference signal for setting a reference when turning on the backlight;

a delay-time setting unit configured to set a delay time for delaying a turn-on time of the backlight from a turn-on time of the reference signal;

a second output unit configured to output a turn-on signal for turning on the backlight at a turn-on time delayed by the delay time from the turn-on time of the reference signal;

a detecting unit configured to detect an identification signal for identifying a type of the liquid crystal display module, wherein the delay-time setting unit is configured to set the delay time depending on the type of the liquid crystal display module indicated by the identification signal;

a determining unit configured to determine whether the control signal is unnecessary for the liquid crystal display module indicated by the identification signal; and a switching unit configured to switch, when it is determined that the control signal is unnecessary for the liquid crystal display module, an output signal from the turn-on signal to the reference signal, wherein the first output unit is configured to generate the control signal based on the reference signal.

2. The liquid crystal display control circuit according to claim 1, wherein the turn-on signal is turned off in synchronization with the reference signal.

3. The liquid crystal display control circuit according to claim 1, wherein a sequence of signals and number of signals to be assigned to a connector that is connected to the liquid crystal display module are identical for different types of liquid crystal display modules.

4. The liquid crystal display control circuit according to claim 1, wherein a pull-up resistor and a pull-down resistor are connectable to the liquid crystal display control circuit, and the delay-time setting unit is configured to set the delay time depending on a connection status of the pull-up resistor and the pull-down resistor.

5. The liquid crystal display control circuit according to claim 1, wherein a resistor that can be switched on and off by a jumper switch is connected to the liquid crystal display control circuit, and the delay-time setting unit is configured to set the delay time depending on a switching status of the resistor.

6. The liquid crystal display control circuit according to claim 1, wherein the delay-time setting unit is configured to set the delay time, which is input via an operating unit.

7. The liquid crystal display control circuit according to claim 1, further comprising a frame-rate changing unit configured to change a frame rate of the liquid crystal display module depending on a turn-on status of the control signal.

8. The liquid crystal display control circuit according to claim 7, wherein the frame-rate changing unit is configured to set a frame rate during a period in which the control signal is turned off to be higher than a frame rate during a period in which the control signal is turned on.

9. The liquid crystal display control circuit according to claim 8, wherein the frame-rate changing unit is configured to set the frame rate during the period in which the control signal is turned off to a highest value in a specification of the liquid crystal display module.

10. The liquid crystal display control circuit according to claim 7, wherein the frame-rate changing unit is further configured to set a frame rate of the liquid crystal display module during a period in which the turn-on signal is turned off to be higher than a frame rate of the liquid crystal display module during a period in which the turn-on signal is turned on.

11. A liquid crystal display control circuit, comprising:

a first output unit configured to output a control signal for removing a residual electric charge from a liquid crystal display module that includes a backlight;

a reference-signal obtaining unit configured to obtain a reference signal for setting a reference when turning on the backlight;

a delay-time setting unit configured to set a delay time for delaying a turn-on time of the backlight from a turn-on time of the reference signal;

a second output unit configured to output a turn-on signal for turning on the backlight at a turn-on time delayed by the delay time from the turn-on time of the reference signal; and a frame-rate changing unit configured to change a frame rate of the liquid crystal display module depending on a turn-on status of the control signal, wherein the first output unit is configured to generate the control signal based on the reference signal; and wherein when changing the frame rate from the frame rate of the liquid crystal display module during the period in which the control signal is turned on to the frame rate of the liquid crystal display module during the period in which the turn-on signal is turned on, the frame-rate changing unit is configured to gradually decrease the frame rate.

12. An operation panel, comprising:

a liquid crystal display; and a liquid crystal display control circuit configured to control the liquid crystal display, the liquid crystal display control circuit including a first output unit configured to output a control signal for removing a residual electric charge from a liquid crystal display module that includes a backlight, a reference-signal obtaining unit configured to obtain a reference signal for setting a reference when turning on the backlight, a delay-time setting unit configured to set a delay time for delaying a turn-on time of the backlight from a turn-on time of the reference signal, a second output unit configured to output a turn-on signal for turning on the backlight at a turn-on time delayed by the delay time from the turn-on time of the reference signal, a detecting unit configured to detect an identification signal for identifying a type of the liquid crystal display module, wherein the delay-time setting unit is configured to set the delay time depending on the type of the liquid crystal display module indicated by the identification signal;

a determining unit configured to determine whether the control signal is unnecessary for the liquid crystal display module indicated by the identification signal; and a switching unit configured to switch, when it is determined that the control signal is unnecessary for the liquid crystal display module, an output signal from the turn-on signal to the reference signal, wherein the first output unit is configured to generate the control signal based on the reference signal.

13. An image forming apparatus comprising an operation panel that includes a liquid crystal display and a liquid crystal display control circuit that controls the liquid crystal display, wherein the liquid crystal display control circuit includes a first output unit configured to output a control signal for removing a residual electric charge from a liquid crystal display module that includes a backlight, a reference-signal obtaining unit configured to obtain a reference signal for setting a reference when turning on the backlight, a delay-time setting unit configured to set a delay time for delaying a turn-on time of the backlight from a turn-on time of the reference signal, and a second output unit configured to output a turn-on signal for turning on the backlight at a turn-on time delayed by the delay time from the turn-on time of the reference signal, a detecting unit configured to detect an identification signal for identifying a type of the liquid crystal display module, wherein the delay-time setting unit is configured to set the delay time depending on the type of the liquid crystal display module indicated by the identification signal;

a determining unit configured to determine whether the control signal is unnecessary for the liquid crystal display module indicated by the identification signal; and a switching unit configured to switch, when it is determined that the control signal is unnecessary for the liquid crystal display module, an output signal from the turn-on signal to the reference signal, wherein the first output unit is configured to generate the control signal based on the reference signal.

* * * * *